US005682633A

United States Patent [19]

Davis

[11] Patent Number: 5,682,633

[45] Date of Patent: Nov. 4, 1997

[54] PILLOW WITH INSERTS

[75] Inventor: E. Scott Davis, Fort Lauderdale, Fla.

[73] Assignee: Banyan Licensing, LLC, Fort Lauderdale, Fla.

[21] Appl. No.: 433,965

[22] Filed: May 4, 1995

[51] Int. Cl.[6] ..... A47G 9/00

[52] U.S. Cl. ..... 5/636; 5/645

[58] Field of Search ..... 5/636, 645, 639, 5/640, 643, 632, 630

[56] References Cited

U.S. PATENT DOCUMENTS

| | | | |
|---|---|---|---|
| 3,648,308 | 3/1972 | Greenwalt | 5/633 |
| 4,803,743 | 2/1989 | Greenwalt | 5/636 |
| 4,829,614 | 5/1989 | Harper | 5/636 |
| 4,916,765 | 4/1990 | Castronovo, Jr. | 5/636 |
| 5,533,218 | 7/1996 | Fahy | 5/636 |

OTHER PUBLICATIONS

"Core Products International" A 1989 Trade Brochure, Products 101–103, 108,109.

*Primary Examiner*—Alexander Grosz

*Attorney, Agent, or Firm*—Bell, Seltzer, Park & Gibson, P.A.

[57] ABSTRACT

The present invention provides a pillow with an insert and lobe of sufficient curvature to enable the user to obtain the intended firmness effects. The pillow includes a compressible and resilient body having a top portion and a bottom portion and a rounded lobe which upwardly protrudes from the bottom portion. Formed within the lobe is an opening which has an insert shaped and dimensioned for snug contact therein. The radius of curvature of the opening is at least 60% of the radius of curvature of the lobe. Inserts of varying compressibility, texture, and contour may be employed in single or multiple openings. Additionally, the pillow may be reversible, offering the user increased versatility.

12 Claims, 5 Drawing Sheets

PILLOW WITH INSERTS

BACKGROUND OF THE INVENTION

1. Field of the Invention

The present invention relates to a pillow. More particularly, this invention relates to a pillow which enables the user to vary the degree of firmness of portion of the pillow.

2. The Prior Art

Contoured pillows have been commercially available for some time. Such pillows are designed to provide therapeutic relief in the neck area. It has been found that it is often desirable for the user to be able to select the firmness characteristics of such a pillow.

An example of such a pillow is disclosed in U.S. Pat. No. 4,916,765 to Castronovo in which a pillow kit is provided having a compressible and resilient cushion body. The resilient cushion body has an opening extending therethrough to accommodate compressible and resilient inserts having differing degrees of firmness. The inserts described in the Castronovo patent have a radius considerably smaller than the radius of the upper surface of the lobes of the pillow. As a result, it is difficult for the end user to effectively obtain the desired compressibility offered by such an insert.

SUMMARY OF THE INVENTION

In accordance with the present invention, there is provided a pillow which allows one to effectively obtain the desired level of firmness in the neck and head areas by varying the compressibility, composition and size of the pillow. The pillow of the present invention includes a compressible and resilient body having a top portion, a bottom portion and at least one rounded lobe which upwardly protrudes from the bottom portion and extends across the width of the body. The lobe has an opening extending across the width of the body. A resilient insert is positioned within the opening so as to provide a desired firmness level. The upper surface of the insert has a radius of curvature that is the same or nearly the same as the radius of curvature of the upper surface of the lobe containing such opening. The user is thus able to optimally employ an insert or inserts having the resilience for a particular firmness, thus obtaining the desired therapeutic benefits.

In one embodiment, a second lobe is present and positioned relative to the first lobe so as to preferably form a trough therebetween. Formed within at least one of the lobes is an opening which extends across the body width. Advantageously, the opening has radius of curvature which is preferably at least 60% of the radius of curvature of the lobe, and, more preferably, at least 80% of the lobe radius of curvature. In the embodiment where the insert forms a part of the upper surface of the lobe the radius of curvature is the same radius as the radius of the lobe itself. In accordance with the invention, these percentages allow the neck to obtain the desired firmness effects of an insert positioned therein.

In another embodiment, the opening extends from the outer surface of and into the pillow body. A pair of opposed walls and a connecting surface extending continuously across the distance between the walls together define the opening. In another embodiment, the opening is in the form of a cylinder. Multiple openings may be employed in either or both lobes.

At least one compressible and resilient insert is positioned within the opening and is shaped and dimensioned for snug contact therein. The insert can encompass a variety of constant or variable compressibilities. In one embodiment, for example, an insert has a top and bottom portion of different firmness levels. In another embodiment, a plurality of inserts of varying compressibilities may be contained in the opening to give the pillow a composite firmness. Advantageously, the insert may additionally contain a series of perforations to impart a varying surface texture to the pillow, and may have a sloped upper surface to offer varied contour.

In an additional embodiment, the lobe or lobes of the present invention may be detachably connected to the pillow body in which a portion of the lobe is an insert which fits into a pillow body. Connecting means serve facilitate connection of the lobe or lobes to the body. The lobes may be of similar compressibility to the pillow body or may vary with respect to each other and/or the body.

In addition, the pillow may be reversible with respect to the top and bottom portions. In one example, a part of the top portion surface may have a series of closely spaced, upwardly protruding rounded ribs with the bottom portion having a series of perforations extending from the surface of the bottom portion into the body. As a result, varied texture is provided to both surfaces. The inserts may be present in openings which are accessed from the bottom portion. As a result, the insert and bottom portion outer surfaces are discontinuous, thus allowing more direct contact to the user's neck. In another embodiment, a mating wedge may be inserted under one end of the lobes to provide greater support to the user's head.

In accordance with the invention, the adjustable pillow is highly desirable. The relationship between the radius of the pillow lobe and opening which contains an insert allows one to effectively obtain the desired level of firmness, contour, and/or texture. Moreover, the versatility of the pillow allows an individual to utilize such in a variety of ways.

It is therefore an object of the present invention to provide a pillow having a desired degree of firmness and comfort in the critical area (i.e., neck) of the pillow.

Another object of the present invention is to provide a contoured pillow in which the desired degree of firmness may be changed to suit the comfort of the user.

Other objects, features and advantages of the invention will be apparent from the detailed description of the invention when taken in conjunction with the accompanying drawings, in which:

DETAILED DESCRIPTION OF THE PREFERRED EMBODIMENTS

Figure 1A:
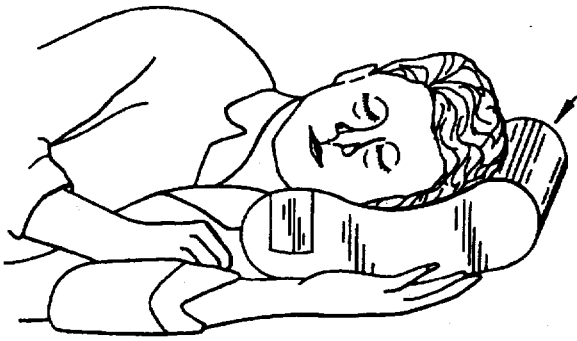
FIG. 1A is an environmental view of a pillow of one embodiment of the present invention.
Figure 1B:
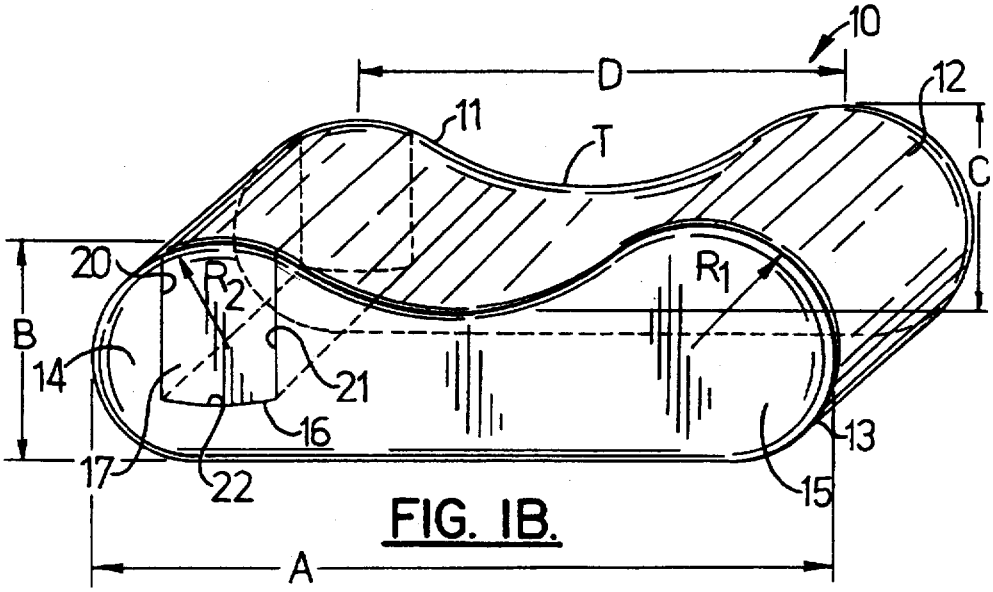
FIG. 1B is a perspective view of a pillow of an embodiment of the present invention having an insert placed therein from the top surface of the pillow.

The present invention now will be described more fully hereinafter with reference to the accompanying drawings, in which the preferred embodiments of the invention are shown. Referring now to FIGS. 1A and 1B, there is provided a pillow 10 having a compressible and resilient body 11 which has a top portion 12, a bottom portion 13 with a substantially flat surface extending across the length of the pillow, a rounded rear lobe 14 and a rounded front lobe 15.

The pillow of the present invention is advantageous in that a user may effectively obtain the intended level of firmness for the neck area, along with a desired size, level of surface texture and/or contour. As will become apparent, the various embodiments of the pillow provide the user with a desirable level of versatility.

In accordance with the invention, the pillow can be comprised of a variety of compressible and resilient materials which are known by those who are skilled in the art. For example, foamed plastic and/or foam rubber are desirable, since they provide softness in addition to firmness and resiliency. The pillow body can comprise numerous known densities and compressibilities. Preferably, the pillow has a ILD values ranging from 15 to 30 lbs. In terms of dimensions, the pillow can be utilized in numerous sizes; for the purposes of the invention, the following are most preferred:

pillow length (denoted by A)=15 inches;

lobe height (denoted by B)=4.5 to 5.0 inches;

height of trough (denoted by C)=2.9 inches; and distance between lobes (denoted by D)=9.6 inches.

As depicted in FIG. 1B, the rounded lobes 14 and 15 upwardly protrude from the bottom portion 13 of the pillow 10 at opposite ends thereof so as to form a trough T therebetween. The lobes may be of similar or different sizes. In accordance with the invention, the upper surfaces of the lobes are rounded to approximate the curvature of a human neck. Accordingly, the lobes should have a radius of curvature (defined by the distance $R_1$) preferably ranging from 2.0 to 4.0 inches. More preferably, the radius of curvature should be about 2.6 inches.

An opening 16 is present in lobe 14 and extends across the width of the pillow body 11. As shown in FIG. 1B, opening 16 is accessed from the top portion 12 and extends from the outer surface into body 11. The opening 16 is defined by a pair of opposed walls 20 and 21 and a connecting surface 22 which extends continuously across the distance of the opposed walls. A compressible and resilient insert 17 is positioned within opening 16. The insert 17 is sized to fit snugly against the walls 20 and 21 and has a radius of curvature on its top surface that is the same radius as the lobe into which it is inserted.

Figure 2:
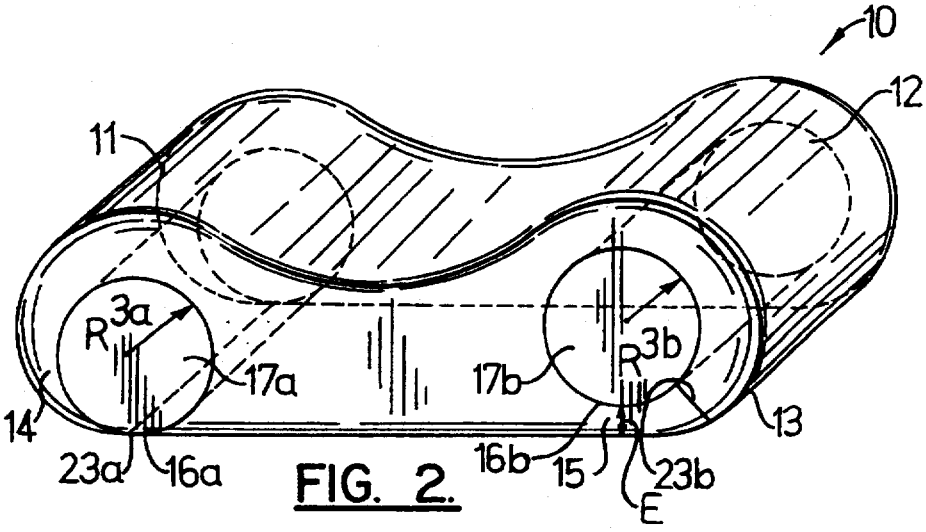
FIG. 2 is a perspective view another embodiment of a pillow having cylindrical inserts.

In another embodiment, that shown in FIG. 2, there are openings **16*a* and 16*b* in lobes 14 and 15 in the form of cylinders, extending across the width of body 11. As illustrated, the circular openings are defined by surfaces 23*a* and 23*b* which are contained within the lobes. Also, as depicted in FIG. 2, the positioning of the openings within the lobes may vary. More particularly, opening 16*a* in rear lobe 14 may be tangent to the bottom portion outer surface, such that it may be accessed through the bottom surface. Regarding the front lobe 15, the opening 16*b* may be located farther into the lobe at a predetermined distance (denoted by E) from the surface of bottom portion 13 such that the opening is accessed through a slit extending from the bottom portion surface to the surface of the opening 23*b***. It should be emphasized that the openings may be positioned differently without departure from the scope of the invention.

Although these preferred opening shapes have been disclosed in FIGS. 1B and 2, it should be emphasized that others may also be employed. Additionally in FIG. 1B, the opening in rear lobe 14 could be located in the front lobe 15 and/or could be accessed from the bottom portion 13.

The inserts 17, similar to pillow body 10, may be of foamed plastic or foam rubber having a variety of density and ILD values. For example, an typical insert density can be 1.5 pounds per cubic foot (similar to pillow 10). Insert compressions may typically vary, for example, between 15 and 35 pounds per cubic foot. For ease of identification, individual inserts may have different colors according to ILD value, which can include, for example, yellow inserts (density 1.5 lbs. per cubic foot ILD value, 12 lbs. per cubic foot), medium blue inserts (density 1.5 lbs. per cubic foot, ILD value of 17 lbs. per cubic foot), dark blue inserts (density 1.5 lbs. per cubic foot, ILD value of 24 lbs. per cubic foot), and dark grey inserts (density 1.5 lbs. per cubic foot, ILD value of 32 lbs.). Other inserts known to those skilled in the art may also be employed. Additionally, individual inserts may be of variable ILD values. While the above described inserts have been directed to the inserts for FIG. 1B, it should be understood that the same criteria for inserts applies to the other embodiments described herein.

Within the scope of the invention, the inserts may contain known accessory components in order to supply the user with additional comfort. For example, heat, massage, and sound may be provided by utilizing such accessories.

Preferably, the inserts utilized in the invention are shaped and dimensioned for snug contact within their respective openings. Nonetheless, a variety of means may be employed to further secure an insert in an opening. In the instances when an insert is designed to be removed and replaced from an opening, it can be kept therein by friction, a hook and loop, surrounding foam, elastic, a pillow case or any other means known to the skilled artisan. Alternatively, an insert may be permanently adhered within an opening by employing any suitable means.

In accordance with the invention, an opening within the pillow 10 should have a radius of curvature relative to the radius of curvature of the lobe (defined herein) containing such an opening so as to allow the user to experience the maximum intended effects of the insert contained therein. For the purposes of definition, the opening 16 illustrated FIG. 1 (and all embodiments employing an opening of similar structure) has a radius of curvature $R_2$ defined by the radius of curvature of bottom connecting surface 22. Regarding the embodiment in FIG. 2 (and all embodiments employing openings of similar structure), each of the openings 16*a* and 16*b* has a radius of curvature, $R^{3a}$ and $R^{3b}$ respectively, defined by the radius of the appropriate cylinder. For the purposes of the invention, the radius of curvature of an opening described above should preferably be at least 60% of the radius of curvature of the corresponding lobe containing such opening. More preferably, the opening radius of curvature should be at least 80% of the radius of curvature of the corresponding lobe.

As described and illustrated in the specific embodiments herein below, the pillow 10 may provide desired degrees of firmness, surface texture, and surface contour in accordance with the selection of the particular insert or inserts. In several of the illustrated examples (i.e., FIGS. 3–7), at least one insert similar in structure to that presented in FIG. 1 is positioned in an opening accessed from the top portion of the rear lobe. Nonetheless, it should be stressed that single or multiple inserts may be employed in an opening or openings contained in any portion (i.e., top and/or bottom) of any of the lobes.

Figure 3:
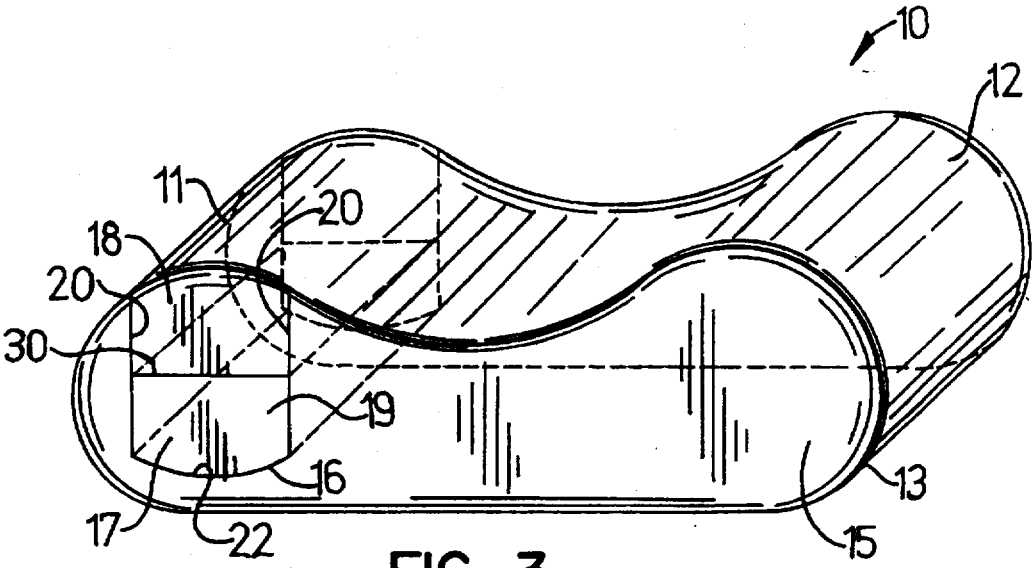
FIG. 3 is a perspective view of a pillow of another embodiment of the present invention in which the insert has top and bottom portions of differing compressibilities or materials.

FIG. 3 illustrates a pillow with an opening 16 containing an insert 17 having an upper section 18 extending from approximately the vertical middle of opening 16 to the surface of the top portion 12, and a lower adjacent section 19 extending from the opening middle to the bottom connecting surface. For the purposes of the invention, the insert portions 18 and 19 may be integrally formed or may be adhered to one another in any suitable fashion known in the art. To provide variable firmness, the upper and lower portions are of different predetermined compressibilities. Most preferably, the insert top portion 18 is softer than the bottom portion 19 allowing the possibility of greater comfort to the user while still providing suitable underlying firmness.

Figure 4:
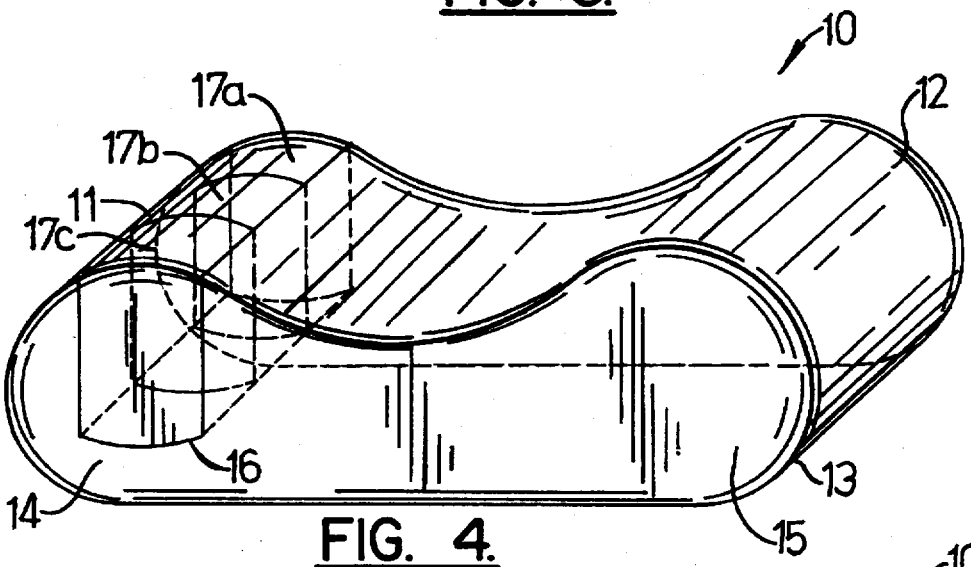
FIG. 4 is a perspective view of a pillow in which a plurality of inserts are positioned to give the pillow a composite firmness.

FIG. 4 illustrates a pillow 10 with an insert having a plurality of parts 17*a–c* positioned in opening 16. Although the insert is shown as having three parts, any number may be used. In addition, the parts may be inserted separately or they may be adhered together to form a single insert of differing firmness. As shown, each insert extends throughout the entire opening height; nonetheless, an insert may extend throughout only a portion of such height. At least two of the inserts have different ILD values so as to give lobe a composite firmness across the width of the insert. In a preferred embodiment, the outside inserts (17*a* and 17*c*) are of the same ILD value while that of insert 17*b* varies from 17*a* and 17*b*.

Figure 5:
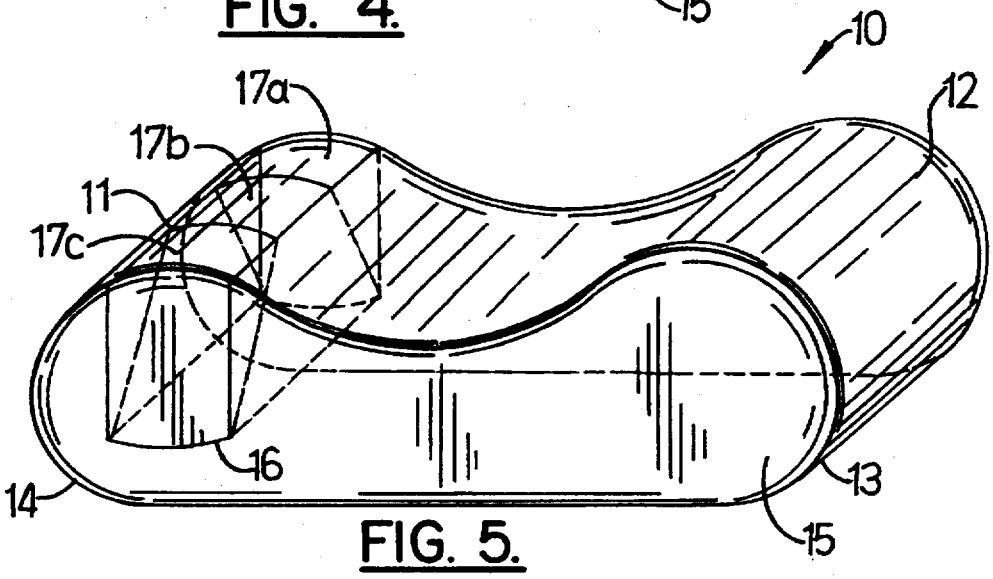
FIG. 5 is a perspective view of the pillow similar to FIG. 4 in which the middle insert is of trapezoidal cross-section so as to provide a gradual change in compressibility across the insert width.

As illustrated in FIG. 4, the inserts are shaped similar to rectangular cubes but with curved tops and bottoms. Nonetheless, other configurations may be employed. For example, FIG. 5 shows the center insert 17*b* having a trapezoidal cross-section relative to the width of pillow body 11, while the two outer inserts (17*a* and *c*) are triangular in cross-section. Although insert 17*b* preferably has a top surface which is smaller than its bottom surface, the sizes of such may be reversed. In accordance with the invention, other inserts may be employed having circular, semicircular, or "V" shapes in cross-section to the body width, for example.

Figure 6:
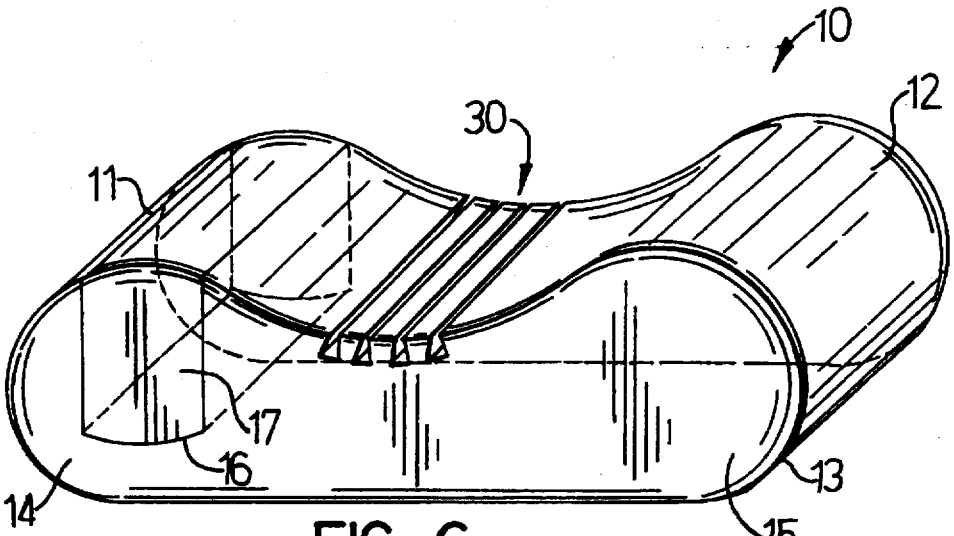
FIG. 6 is a perspective view illustrating an insert with perforations formed on the pillow top surface and a pillow containing such an insert.

FIG. 6 illustrates a pillow 10 containing insert 17 having a series of incisions 30 extending from the insert surface to a predetermined distance therebelow which accordingly provides the user with varied pillow surface texture. For the purposes of the invention, the incisions 30 can extend across the entire width of the insert or only over a portion of such distance. As illustrated in FIG. 6, four incisions are present; nonetheless, this should not serve as a limitation upon a number which may be employed. Moreover, the length between individual incisions and the depth of such incisions may all vary to accommodate the level of comfort desired.

Figure 7:
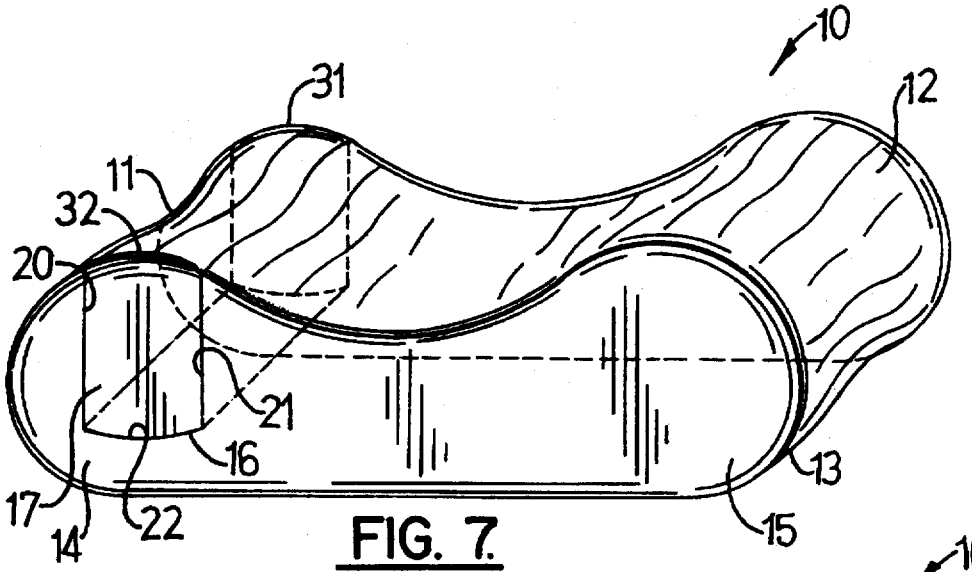
FIG. 7 is a perspective view of a pillow of the present invention utilizing an insert having a varied surface contour.

FIG. 7 depicts a pillow 10 in which insert 17 can be of varied slope to form a contoured surface. In this example, opposed transverse ends (31 and 32) of insert 17 are at a height approximately equal to the lobe height. As illustrated, the insert surface slopes downward from each end so as to form a valley on slight depression in the middle region of the insert 17. Preferably, the degree of slope from each of the ends to the center is similar such that the insert surface contour is symmetrical with respect to the middle region. Nonetheless, an unsymmetrical contoured surface may also be formed.

Figure 8A:
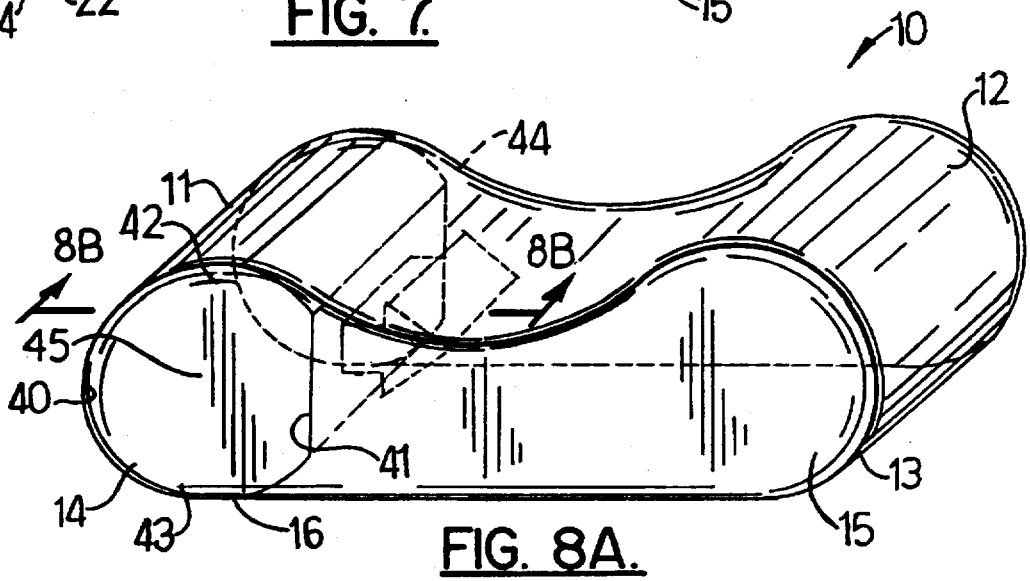
FIG. 8A is a perspective view of another embodiment of a pillow of the present invention in which one of the lobes is detachably connected to the pillow body.
Figure 8B:
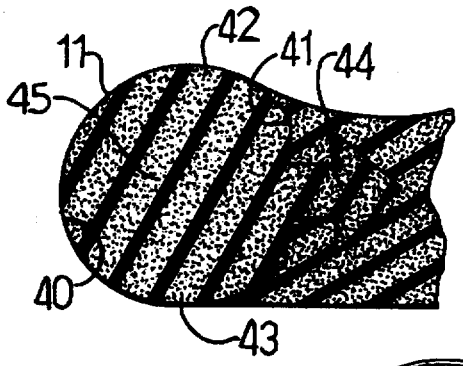
FIG. 8B is a partial side view taken along line 8B—8B of FIG. 8A.

In an embodiment illustrated in FIG. 8A, the rear lobe 14 is detachably connected to pillow body 11. As depicted, the opening 16 is accessed from the cross-sectional width of the pillow, and is defined by two opposed walls 40 and 41, upper and lower surfaces 42 and 43, and a cavity 44 of predetermined size and shape as shown in FIG. 8B. A portion of lobe 14 is in the form of a compressible and resilient insert 45 positioned within opening 16.

Lobe 14 may be detachably connected to body 11 by a connecting means exemplified by a locking friction means such as the expanded foam portion shown in FIG. 8B. In addition, elastic, a hook and/or loop, snaps, or a pin insert may be used. Also, a pillow case may be employed to secure the lobe 14 to body 11.

Figure 9:
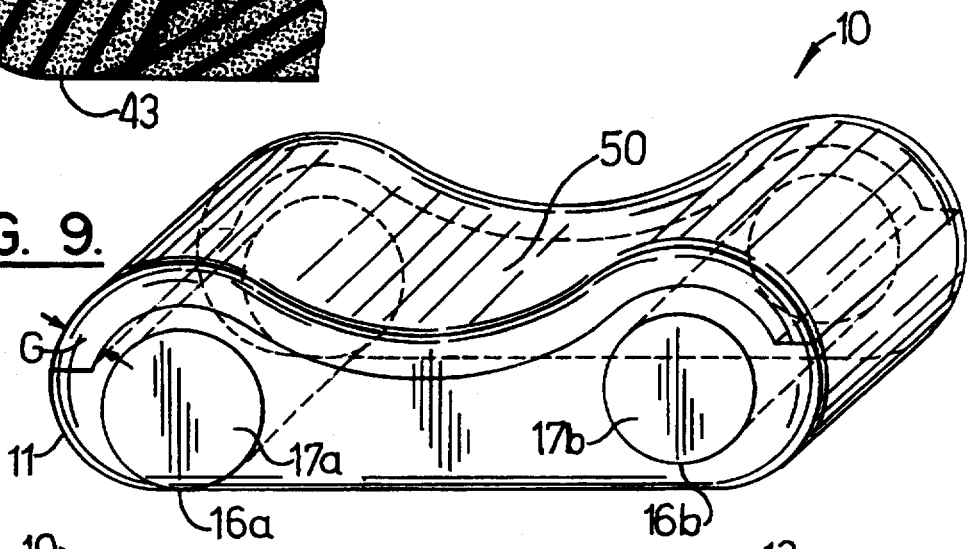
FIG. 9 is a perspective view of another embodiment of the present invention showing a pillow in which a top section is secured to the remainder of the pillow body.

FIG. 9 illustrates an embodiment in which a top section 50 is secured to pillow body 11. As shown, the top section 50 comprises the upper surface of the pillow and is contoured such that rear and front lobes are formed at opposed longitudinal ends of the pillow. Preferably, the top section is made of convoluted foam has a varying density and a ILD value of at least 15 lbs. In terms of dimensions, the thickness of section 50 preferably ranges up to about 3 inches (denoted by G). The top section is preferably adhered to pillow body by appropriate and known adhesives, although any suitable means may be employed to secure section 40 to pillow body 11. As shown, cylindrical openings 16*a* and 16*b* with inserts 17*a* and 17*b* contained therein are present which are structurally similar to those defined in FIG. 2.

Figure 10:
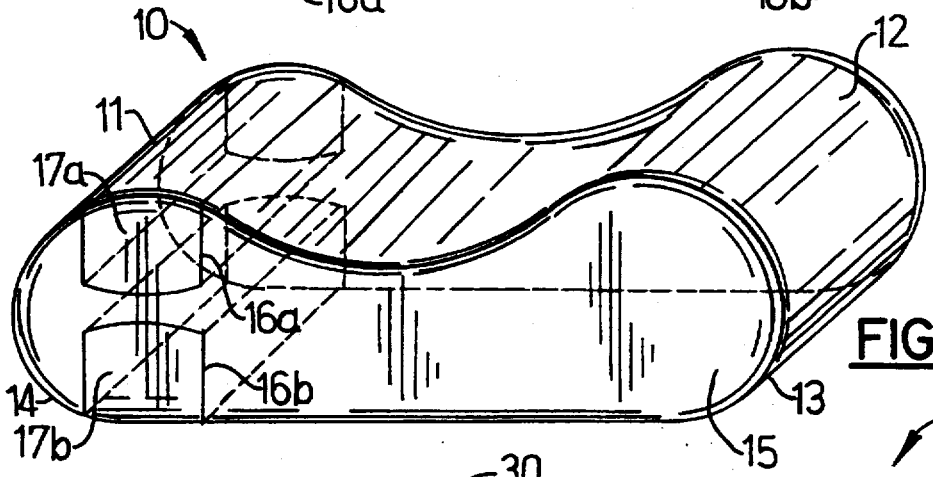
FIG. 10 is a perspective view of another embodiment of the present invention showing a pillow utilizing a pair of inserts located in top and bottom portions of a lobe such that the pillow may be reversible.

The pillow of the invention may be reversible; i.e, the pillow may be inverted such that the top and bottom portions exchange positions. FIG. 10 illustrates an example of such in which two openings 16*a* and 16*b* are positioned in the lobe 14 at opposite vertical locations (i.e., one in the top portion 12 and one in the bottom portion 13) with inserts 17*a* and 17*b* contained therein. As depicted, insert 17*b* has a surface which is discontinuous with the bottom surface. Accordingly, when the user contacts the insert of the bottom portion, a more direct level of contact will be realized in comparison to insert 17*a* contacted by a user on the top portion. The inserts may vary with respect to firmness and size, and may be located in only the rear lobe 14 as illustrated, the front lobe 15, or both lobes. The inserts may also be permanent or removable.

Figure 11:
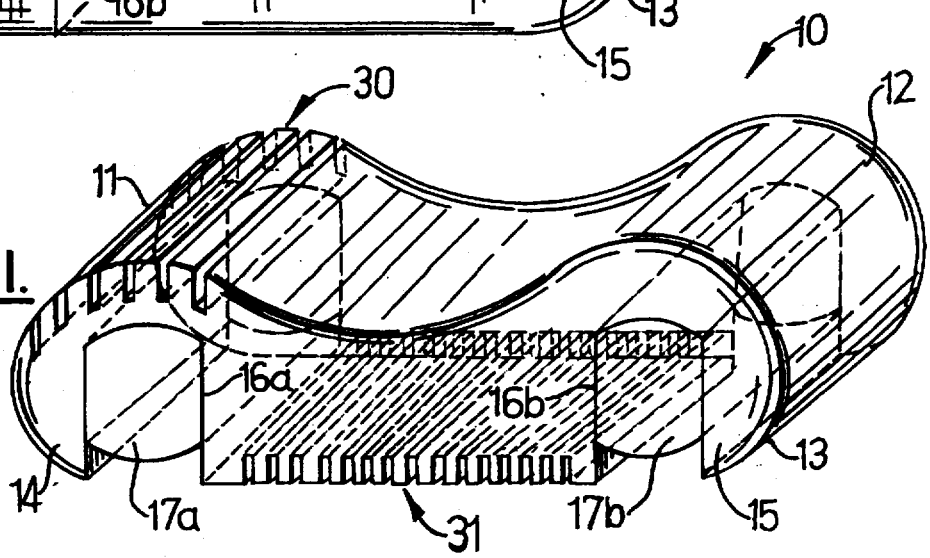
FIG. 11 is a perspective view of a pillow of the present invention which may be reversible in which the top and bottom surfaces are of varied surface texture with inserts being located in the pillow bottom.

FIG. 11 illustrates another embodiment of a reversible pillow 10. As shown, across at least a part of the top portion 12, a series of closely spaced, upwardly protruding rounded ribs or ridges 30 are present within body 11 which preferably extend across the pillow body width. It should be noted that the presence of ridges 30 offers softer support in comparison to a surface without such present. Regarding dimensions, the ribs preferably have a width of about 0.30 to about 1.0 inches, most preferably about 0.7 inches. The ribs are spaced a sufficient amount to provide the desired surface condition, generally about 0.15 to about 0.20 inches apart. With respect to surface contour, the top and bottom surfaces of the ribs should preferably be similar to the curvature of the top portion surface.

Both lobes contain openings similar in structure to the opening presented in FIG. 1; in FIG. 11, however, the openings are accessed from bottom portion 13. Similar to insert **17*b* presented in FIG. 10, the inserts in this embodiment offer a firm level of support due to more direct contact with the user's neck. Between the openings, a series of spaced perforations 31 are present on the bottom surface extending to a predetermined distance within the pillow body 11**. As a result, the user may experience varied surface texture.

Figure 12:
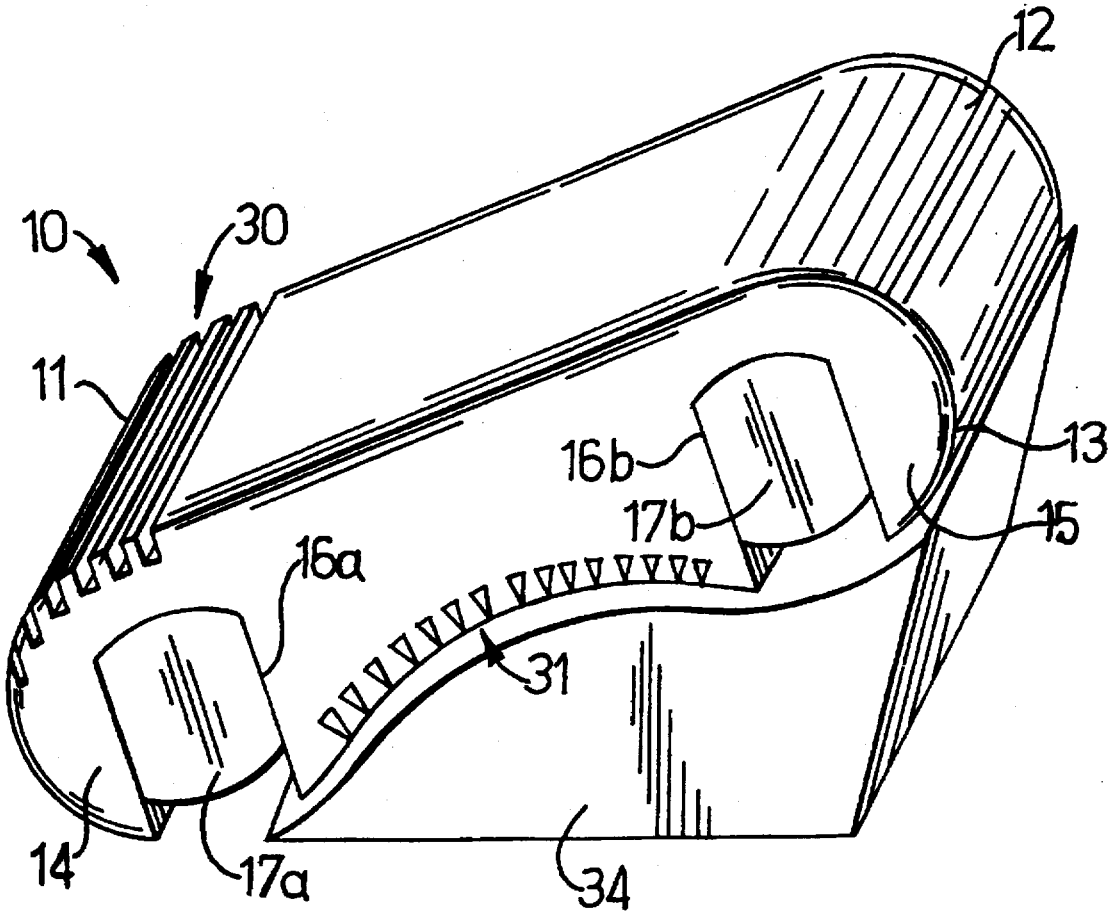
FIG. 12 is a perspective view of the pillow illustrated in FIG. 11 which is reversed and having a mating wedge positioned under the pillow to provide support to a user's head.

FIG. 12 illustrates an embodiment in which the pillow of FIG. 11 has been reversed with pillow mating wedge 34 being positioned at one end of the pillow. Advantageously, the wedge 34 is designed to provide support for a user when reading, watching T.V., or participating in other activities.

The invention has been described in detail with particular reference to preferred embodiments, but it is understood that variations, modifications and substitution of equivalent means may be affected within the spirit of this invention.

What is claimed is:

1. A pillow comprising:

a compressible and resilient body having a top portion, a bottom portion, and at least one rounded lobe upwardly protruding from said bottom portion and extending across the width of said body having an upper surface rounded to approximately the curvature of a human neck;

at least one opening formed in said at least one lobe and extending across the width of said body;

at least one compressible and resilient insert positioned within said at least one opening, said insert having a radius of curvature substantially the same as the radius of curvature of said lobe; said opening being shaded and dimensioned for snug contact of said insert therein wherein said at least one opening is accessed from said top portion.

2. The pillow according to claim 1, wherein said at least one insert has an upper portion and a lower portion wherein each portion has a compressibility different from the other portion.

3. The pillow according to claim 1, comprising a plurality of inserts positioned within said at least one opening and adjacent to one another, each of said inserts being shaped and dimensioned for snug contact within said opening and extending vertically throughout at least a portion of the height of said opening and at least two of said inserts having different compressibilities.

4. The pillow according to claim 1, wherein said at least one insert comprises a plurality of distinct incisions extending from the surface of said insert to a predetermined distance therein.

5. The pillow according to claim 1, wherein the outer surface of said at least one insert is of varied slope across the width of said body.

6. A pillow comprising:

a compressible and resilient body having a top portion, a bottom portion, a rounded front lobe, and a rounded rear lobe having an upper surface rounded to approximately the curvature of a human neck, said lobes protruding upward from said bottom portion at opposing ends of said body forming a trough therebetween;

at least one opening formed in the top of said rear lobe and extending across the width of said body, and said opening extending from the outer surface of said top portion and into said body, said opening being defined by a pair of opposing walls and a connecting surface extending across the distance between the opposed walls; and at least one compressible and resilient insert positioned within said opening, said insert having a radius of curvature at least 80% of the radius of curvature of said rear lobe, said opening being shaped and dimensioned for snug contact of said insert therein.

7. The pillow according to claim 6, wherein said at least one insert comprises a plurality of distinct perforations extending from the surface of said insert to a predetermined distance therein.

8. The pillow according to claim 6, wherein the outer surface of at least one insert is of varied slope across the width of said body.

9. A pillow comprising:

a compressible and resilient body having a top portion, a bottom portion, a rounded front lobe, and a rounded rear lobe having an upper surface rounded to approximately the curvature of a human neck, said lobes protruding upward from said bottom portion at opposing ends of said body forming a trough therebetween;

at least one opening formed in the top of said rear lobe and extending across the width of said body, and said opening extending from the outer surface of said top portion and into said body, said opening being defined by a pair of opposing walls and a connecting surface extending across the distance between the opposed walls; and at least one compressible and resilient insert positioned within said opening, said insert having a radius of curvature at least 80% of the radius of curvature of said rear lobe, said opening being shaped and dimensioned for snug contact of said insert therein, wherein said at least one insert having an upper portion and a lower portion, each portion having a predetermined compressibility different from the other portion.

10. A pillow comprising:

a compressible and resilient body having a top portion, a bottom portion, a rounded front lobe, and a rounded rear lobe having an upper surface rounded to approximately the curvature of a human neck, said lobes protruding upward from said bottom portion at opposing ends of said body forming a trough therebetween;

at least one opening formed in the top of said rear lobe and extending across the width of said body, and said opening extending from the outer surface of said top portion and into said body, said opening being defined by a pair of opposing walls and a connecting surface extending across the distance between the opposed walls; and at least one compressible and resilient insert positioned within said opening, said insert having a radius of curvature at least 80% of the radius of curvature of said rear lobe, said opening being shaped and dimensioned for snug contact of said insert therein, further comprising a plurality of inserts positioned within said at least one opening and adjacent to one another, each of said inserts being shaped and dimensioned for snug contact within said opening and extending vertically throughout at least a portion of the height of said opening and at least two of said inserts having different compressibilities.

11. A pillow comprising:

a compressible and resilient body having a top portion, a bottom portion, and a first rounded lobe upwardly protruding from said bottom portion and extending across the width of said body and a second rounded lobe upwardly protruding from said bottom portion and extending across the width of said body;

at least one opening formed in said at least one of said lobes and extending across the width of said body;

at least one compressible and resilient insert positioned within said opening, said insert having a radius of curvature which is at least 80% of the radius of curvature of said lobe; said opening being shaped and dimensioned for snug contact of said insert therein wherein said at least one opening extends into said body, said opening being defined by a pair of opposed walls and a connecting surface extending continuously across the distance between the opposed walls;

a second opening formed in said at least one lobe and extending across the width of said body wherein said second opening is accessed from the opposite portion that said at least one opening is accessed from, said second opening extending from the outer surface of said body and into said body and being defined by a pair of opposing walls and a connecting surface extending continuously across the distance between said opposed walls; and a second compressible and resilient insert positioned within said second opening, said second insert shaped and dimensioned for snug contact therein.

12. The pillow according to claim 11, wherein said inserts are of different predetermined compressibilities.

* * * * *